US010071351B2

(12) United States Patent
Rüberg et al.

(10) Patent No.: US 10,071,351 B2
(45) Date of Patent: Sep. 11, 2018

(54) INDUSTRIAL MIXING CONTAINER AND LINER AND METHOD OF USE

(71) Applicant: Dr. Herfeld GmbH & Co. KG, Neuenrade (DE)

(72) Inventors: Wolfgang Rüberg, Menden (DE); Ulrich Tölle, Detmold (DE)

(73) Assignee: DR. HERFELD GMBH & CO. KG, Neuenrade (DE)

( * ) Notice: Subject to any disclaimer, the term of this patent is extended or adjusted under 35 U.S.C. 154(b) by 1057 days.

(21) Appl. No.: 14/456,044

(22) Filed: Aug. 11, 2014

(65) Prior Publication Data

US 2015/0078119 A1 Mar. 19, 2015

(30) Foreign Application Priority Data

Aug. 9, 2013 (DE) ..... 20 2013 103 591 U

(51) Int. Cl.
*B01F 15/00* (2006.01)
*B01F 7/16* (2006.01)
*B01F 15/02* (2006.01)

(52) U.S. Cl.
CPC ..... *B01F 15/00837* (2013.01); *B01F 7/1605* (2013.01); *B01F 15/0292* (2013.01)

(58) Field of Classification Search
CPC ..... B01F 15/00837; B01F 15/0292; B01F 15/0293; B01F 15/0274; B01F 15/0266; B01F 7/1605
USPC ..... 366/76.92, 192–193
See application file for complete search history.

(56) References Cited

U.S. PATENT DOCUMENTS 2,398,985 A * 4/1946 Welch ..... B05C 17/00516 222/390
2,797,903 A 7/1957 Urban
4,889,432 A * 12/1989 Patterson ..... A61C 9/0026 222/388
4,951,843 A 8/1990 Paetow
5,727,878 A 3/1998 Sullivan, Jr.
(Continued)

OTHER PUBLICATIONS

European Search Report dated Sep. 30, 2015 in related application EP 14179640.9.

*Primary Examiner* — David C Mellon
*Assistant Examiner* — Liam A Royce
(74) *Attorney, Agent, or Firm* — Polson Intellectual Property Law, PC; Margaret Polson; Christopher R. Sylvain

(57) ABSTRACT

An inner 11 for lining a mixing vessel 1 comprising a feed opening 4 on the upper side and a flange 5 projecting outward in the radial direction and on the lower side a discharge duct 8 with a discharge flap valve 23 that can be adjusted from an open position into a closed position and vice versa, which mixing vessel 1 with bulk material introduced into it for the process of blending can be connected onto a mixing head 18 of an industrial blender 19, said mixing supporting one or multiple mixing tool(s), which inner liner 11 bears a supporting flange joint 17 on the upper side projects outward in the radial direction, and, when inserted into the mixing vessel 1, comes to bear against the flange 5 of the mixing vessel 1 and on its bottom side comprises a discharge duct extension 14, projecting into the discharge duct 8 of the mixing vessel 1, which projects into the discharge duct 8 of the mixing vessel 1 with a length that is at least sufficient to reach the discharge flap valve 23 when it is the closed positon.

6 Claims, 2 Drawing Sheets

(56) References Cited

U.S. PATENT DOCUMENTS

| | | | | |
|---|---|---|---|---|
| 6,505,657 | B1 | 1/2003 | Lawrence | |
| 8,678,639 | B2 | 3/2014 | Tolle et al. | |
| 8,979,354 | B2 | 3/2015 | Tolle et al. | |
| 2009/0008356 | A1* | 1/2009 | Gadzic | B65D 47/265 215/310 |
| 2009/0040868 | A1* | 2/2009 | Tamminga | B01F 7/245 366/318 |
| 2010/0065149 | A1* | 3/2010 | O'Callaghan | B01F 3/12 141/98 |
| 2013/0186834 | A1* | 7/2013 | Vicalvi | G01N 30/56 210/656 |

* cited by examiner

INDUSTRIAL MIXING CONTAINER AND LINER AND METHOD OF USE

CROSS REFERENCE APPLICATIONS

This application claims the benefit of German Application No. 20 2013 103 591.2 filed Aug. 9, 2013, which is incorporated herein by reference for all purposes.

BACKGROUND

Industrial blenders for mixing bulk material are well known in the art. A typical application for such blenders is the mixing of color pigments or the provision of plastic pellets such as those required as raw material for the plastics processing industry. This type of mixing vessel is a steel vessel with a spheroidal cross-section. The vessel has a feed opening on its upper side and a vessel flange that projects outward in the area of its upper end. Such a mixing vessel normally has an upper cylindrical section with an adjacent conical section facing downward which tapers the internal diameter of the mixing vessel like a funnel to the discharge duct on the bottom section.

A discharge flap valve is mounted on a swivel axis within the discharge duct and can be adjusted between an open position and a closed position, and vice versa. The discharge duct also typically has a circular cross-sectional area. The discharge flap valve, which has an outer contour that is correspondingly circular or somewhat oval, has a gasket on its outer perimeter that seals the discharge flap valve against the inside wall of the discharge duct in the closed position. The mixing vessel is then sealed.

The flange of the mixing vessel is connected with the complementary flange of a mixing head of an industrial blender to mix the materials. The mixing head itself has one or more mixing tools. Once the mixing vessel filled with the material to be blended is connected to the mixing head, the entire unit is rotated by 180° such that the mixing head is at the very bottom and the mixing vessel is at the very top. In this position, the material to be blended in the mixing vessel first drops onto the mixing tools. Thus the mixing chamber in which the material is mixed is formed by the cavity provided by the mixing vessel and that provided by the mixing head. At least one mixing tool is driven in a rotational direction to perform the mixing operation and generates a flow of blended material within the mixing space formed by the mixing vessel and the mixing head. The mixing space is shaped to allow good rotational flow of the material to be mixed in a known manner. As a rule, a certain amount of heat input into the mix is unavoidable during a mixing operation, particularly due to the shear forces occurring between the mixing tool(s) and the particles of the mixture, but also when mixture particles impact against the inner wall of the mixing vessel. This sometimes leads to material build-up on the mixing vessel wall, particularly in those areas impacted by the mixed material flow.

Such industrial blenders are typically used for mixing different mixtures. Largely as a result of the potential caking mentioned above, any blender components coming into contact with the mixture must be cleaned before they are used for a different mixture. Depending on the size and the type of blended material, the time required for cleaning the mixing vessel alone can be as long as 1-2 hours. Cleaning the mixing head is much easier, however, because caking on its walls is highly unlikely. Moreover, the mixing tool(s) can be easily removed and cleaned outside of the mixing head.

Cleaning the inner surface of the mixing head is also significantly easier than cleaning the inside of the mixing vessel.

The foregoing example of the related art and limitations related therewith are intended to be illustrative and not exclusive. Other limitations of the related art will become apparent to those of skill in the art upon a reading of the specification and a study of the drawings.

SUMMARY

The disclosure relates to an inner liner for lining a mixing vessel, similar to those used in industrial blenders. Also described is an arrangement, comprising a mixing vessel with an inner liner inserted therein and a method for operating an industrial blender with a mixing vessel that is lined with an inner liner.

Based upon this discussed prior art, the object of the invention is to propose a solution that significantly simplifies the cleaning of a mixing vessel.

On aspect of the mixing vessel of the present disclosure is to have an inner liner for an industrial mixing vessel of the discussed type having on its top side a flange that projects outward in a radial direction and comes to bear against the flange that rests against the flange of the mixing vessel when inserted into the mixing vessel. The inner liner has on its bottom side has a discharge duct extension of such length that it extends into the discharge duct of the mixing vessel at least up to the discharge flap valve in its closed position.

The use of an inner liner that lines the inside wall of the mixing vessel prevents the inside wall of the mixing vessel from coming into contact with the mixture, especially during the mixing operation. Consequently, any caking against the wall that may occur forms on the inside of the inner liner and not on the inside wall of the mixing vessel. The inner liner itself is a component typically produced from a film, and can be used for a single or even multiple mixing operations with the same mixture. Such an inner liner is typically a disposable product and can be produced from plastic in a particularly cost-effective manner. It is envisaged that the inner lining is removed from the mixing vessel after a mixing operation and discarded if a different mixture is to be blended. The inner liner itself is detachably inserted into the cavity of the mixing vessel. In a depicted embodiment the liner is held in the vessel by clamping.

The cleaning of the mixing vessel itself is thus in principle limited only to the area of the discharge flap valve or the discharge duct. Because the flow of the mixture does not flow against, or at least not directly against, said flap valve, little or no caking occurs on it during a mixing operation. Cleaning is therefore easy. Simply wiping off the mixing vessel is typically sufficient to remove any residual particles of a mixture.

Some users of such industrial blenders have washing systems for flushing out the used mixing vessels. Any cleaning solution that accumulates during this process must be separately disposed of, or be purified again. These problems do not exist when using a disposable cost-effective inner liner. Therefore, not only is the time for cleaning the mixing vessels reduced significantly, but there is also no need for a time-consuming purification of the cleaning liquid before its disposal.

The dimensions of such inner liner correspond to the dimensions of the cavity of the mixing vessel. Such an inner liner can be produced from suitable plastic at reasonable cost. The plastic material used for producing the liner must be inert with respect to the material to be blended therein.

The use of a polyethylene material for the inner liner, particularly a so-called LDPE grade, is especially beneficial. The use of LDPE material for the inner liner is especially suitable when color pigments are to be mixed in it. The wall thickness of the liner must be sufficient to withstand the loads that occur during the mixing operation. This involves a certain temperature resistance and sufficient mechanical stability against the impinging particles of the mixture during the mixing operation. For this reason, the selected wall thicknesses must not be too thin. The wall thickness is typically between approximately 0.5 to 1.5 mm.

Even though such an inner liner can in principle be produced as a single piece, it is also possible to manufacture it from several individual pieces. These are then preferably welded together. An inner liner having an upper cylindrical section, an adjoining tapered portion, and a discharge duct will be manufactured in four sections, which are then joined together by welding. These individual pieces are the upper cylindrical section, the tapered section, the cylindrical discharge duct section, and the flange arranged on the outside relative to the feed opening.

By using such inner liner, it is possible to perform a process for blending a bulk material mixture in a mixing vessel connected with a mixing head of an industrial blender by means of the following steps:

Providing a mixing vessel with a feed opening on the top as well as a flange that projects outward in the radial direction, and a discharge duct arranged on the bottom with a discharge flap valve that can be adjusted from an open position into a closed position and vice versa, Inserting an inner liner into the mixing vessel to line its inner wall and its discharge duct, reaching at least up to the discharge flap valve in its closed position, Closing the discharge flap valve of the mixing vessel and clamping of the component(s) of the discharge duct extension of the inner liner that extend up to the discharge flap between the discharge flap valve and the inner wall of the discharge duct, Filling of the mixing vessel lined with the inner liner with the material to be blended through the top feed opening, Connecting the mixing vessel to the mixing head of an industrial blender, during which procedure the flange of the inner liner facing outward is clamped between the flange of the mixing vessel and a complementary flange on the mixing head, Building-up of a positive pressure within the mixing chamber formed by the mixing vessel with its inner liner and the mixing head, Performing the mixing operation, typically in an overhead inverted arrangement of mixing vessel and mixing head, wherein the mixing head is arranged below the mixing vessel, After completion of the mixing operation: removing the vessel from the mixing head and draining of same by opening the discharge flap valve and allowing the blended mixture to run out, and subsequently, if necessary, removal of the inner liner, which is to be done if another mixture is to be blended in the mixing vessel afterwards.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
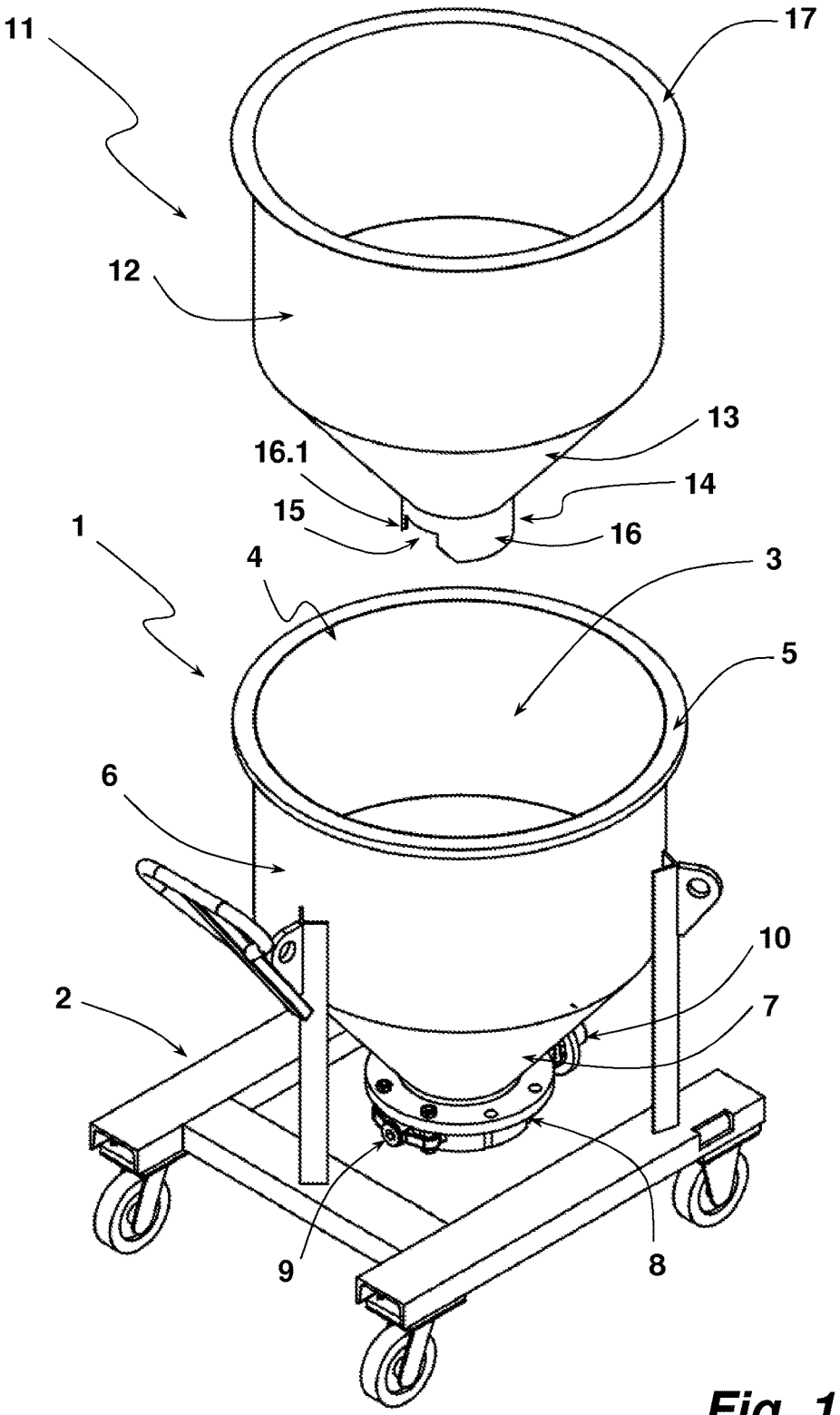
FIG. 1 is a perspective view of a mixing vessel with an inner liner to be inserted therein, fitted onto a cart.
Figures 2, 3, 4:
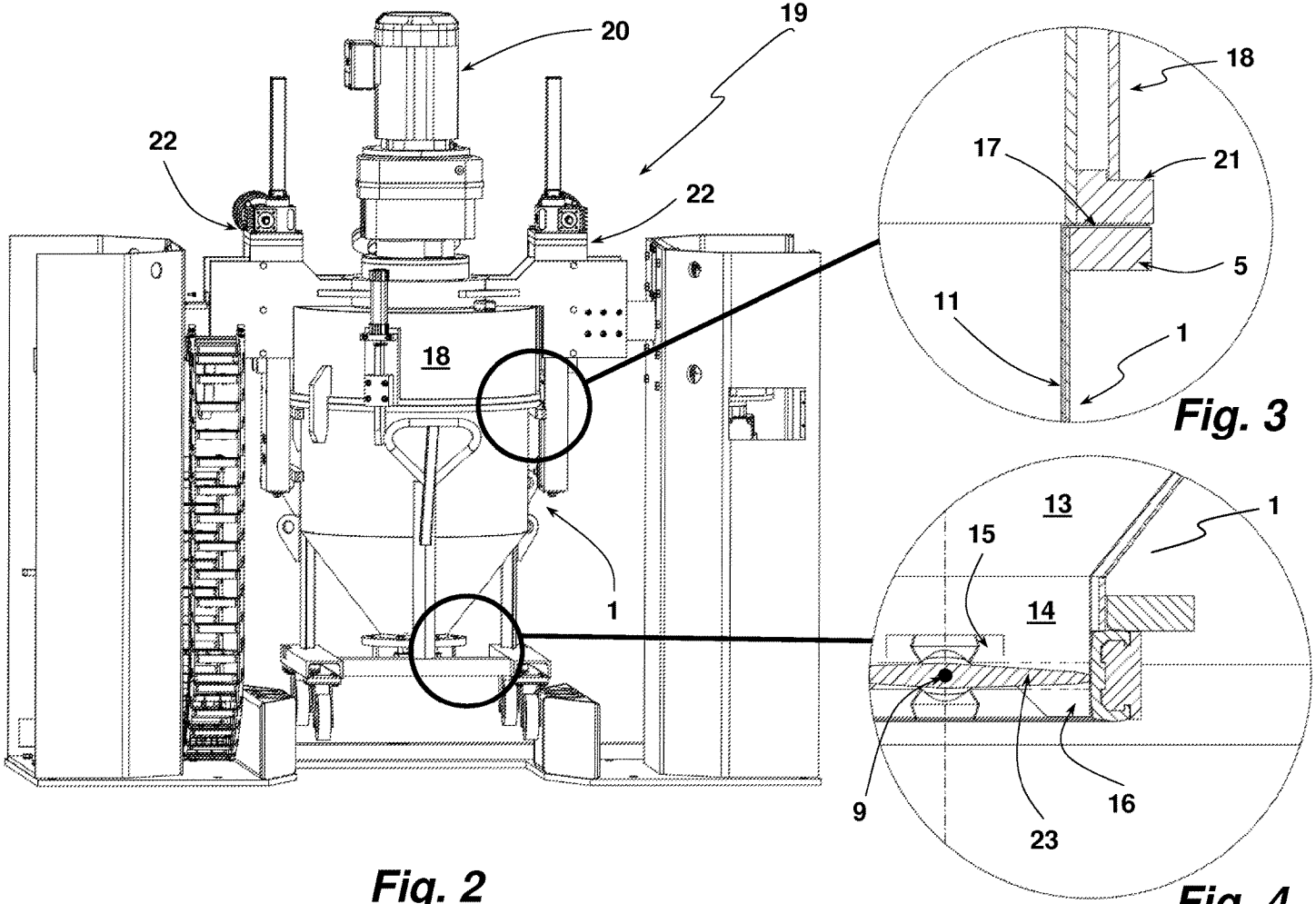
FIG. 2 is a perspective view the mixing vessel of FIG. 1 with the inner liner inserted therein, connected to the mixing head of an industrial blender.
FIG. 3 is an enlarged view of circle 3-3 of FIG. 2.
FIG. 4 is an enlarged view of circle 4-4 of FIG. 2.

Referring FIGS. 1 and 2, a mixing vessel 1 manufactured from steel is fitted onto a cart 2. The mixing vessel 1 illustrated in FIG. 1 is a type of mixing vessel that is known and is already frequently in use. The cart 2 is used for moving the mixing vessel 1. The mixing vessel 1 encloses a cavity 3. The mixing vessel 1 is open on top, wherein the upper opening serves as feed opening 4. The feed opening 4 is surrounded by a mixing vessel flange 5 that radially projects outward. The flange 5 is used to connect the mixing vessel 1 to a mixing head of an industrial blender, wherein said mixing head supports one or multiple mixing tools. The section 6 of the mixing vessel 1 adjacent to the flange 5 of the mixing vessel 1 has an annular cylindrical design in the depicted embodiment. The bottom side of the internal width of the annular cylindrical section 6 has a tapering section 7, said section 7 merging into a bottom discharge duct 8. The discharge duct 8 has a cylindrical inner lateral surface with a discharge flap valve disposed therein, which can be adjusted between an open position and a closed position, and vice versa. The discharge flap valve is adjustable by means of a swivel motion. In FIG. 1, this pivot axis is indicated with reference symbol 9. A handle 10 is used for adjusting the discharge flap valve. In the closed position, the discharge flap valve seals against the inner wall of the discharge duct 8. In the open position, the plane of the discharge flap valve 8 extends parallel or approximately parallel to the inner wall of the discharge duct 8.

Before material to be blended is fed into the cavity 3 of the mixing vessel 1 while the discharge flap valve is closed, an inner liner 11 is inserted into the mixing vessel 1.

The inner liner 11 completely or nearly completely lines the interior of the mixing vessel 1 in the manner of a protective film. The size and dimensions of the inner liner 11 are adapted to the size of the interior 3 of the mixing vessel 1. The outside of the inner liner 11 therefore abuts against the inner wall of the mixing vessel 1. The inner liner 11 likewise has an annular cylindrical section 12 that corresponds to the geometry of the mixing vessel 1, an adjacent tapered section 13, and a discharge duct extension 14 that extends into the discharge duct 8 of the mixing vessel 1. The discharge duct extension 14 extends beyond the discharge flap valve into the discharge duct 8. This is made possible by inserting diametrically opposite axle recesses 15 into the discharge duct extension 15. Because of the illustrated perspective in FIG. 1, only one axle recess 15 is visible.

When the inner liner 11 is inserted into the mixing vessel 1 said recesses are located around the shaft forming the pivot axis 9 on which the discharge flap valve is seated. The axle recesses 15 create two clamping extensions 16, 16.1, which extend beyond the discharge flap valve when it is in the closed position. The clamping extensions 16, 16.1 can extend up to the lower end of the discharge duct 8 or even beyond. Furthermore, a radially outward projecting supported flange joint 17 is molded on the top side of the annular cylindrical section 12 of the inner liner 11. With the inner liner 11 inserted into the mixing vessel 1, said flange joint 17 bears on the upper side of the mixing vessel flange 5.

The inner liner 11 of the illustrated embodiment consists of a low-density polyethylene, a so-called LDPE. In the illustrated embodiment, the inner liner 11 consists of four individual prefabricated parts, which are joined together by welding. The individual components are the discharge duct extension 14, the two sections 12, 13, and the supported flange joint 17. The costs for producing the inner liner 11 are very low compared to the expenditure associated with cleaning the inside of the mixing vessel 1 after a mixing operation. The inner liner illustrated in the Figures is a disposable product. It is designed so that in principle, one mixing operation can be performed therein. Naturally, the inner liner 11 can also be left in the mixing vessel 1 after a first mixing operation if several batches of the same mixture are to be blended consecutively in the mixing vessel 1. The design of the inner liner 11 in the illustrated embodiment is such that it can be used for multiple mixing operations.

FIG. 2 illustrates the mixing vessel 1 connected to the mixing head 18 of an industrial blender 19. Mixing tools that can be rotated are arranged inside the mixing head. An electric motor 20 is used for driving said mixing tools. The mixing vessel 1, together with the inner liner 11 previously inserted therein and the fed-in mixture, was advanced with its flange 5 to a complementary flange 21 of the mixing head 18, and is pressed against the mixing head flange 21 by means of a clamping mechanism 22. The supported flange joint 17 is engaged between the two flanges 5, 21 of the inner liner 11. If it is not possible to do without a seal as otherwise required between flanges 5, 21, a further refinement provides for fitting such a seal onto flange 17 of the inner liner, for example by vulcanizing. The inner liner will then likewise perform the function of providing a seal between the mixing vessel 1 and the mixing head 18, which eliminates the need for disassembly, cleaning, and the subsequent reassembly of the seal of the mixing vessel flange 5 or the mixing head 18. FIG. 3 illustrates this connection, although without the use of a seal, by means of an enlarged longitudinal section of circle 3-3 of FIG. 2.

On the bottom, the inner liner 11 is held clamped in the mixing vessel 1 by its two clamping extensions 16, 16.1 in the discharge duct 8 being held the discharge flap valve 23 in the closed position. The discharge flap valve 23 can be seen in the enlarged longitudinal sectional view of FIG. 4 of circle 4-4 of FIG. 2. There the discharge flap valve 23 is shown in its closed position. In this position, its peripheral side acts against the inside wall of the clamping extensions 16, 16.1 of the discharge duct extension 14, which in turn are pressed with their outside against the inside wall of the discharge duct 8. The inner liner 11 must be fixed in the area of the discharge duct 8 in the manner described above so that it does not move if the unit formed by the mixing vessel 1 and the mixing head 18 is in an over-head configuration for the mixing operation. After connecting the mixing vessel 1 to the mixing head 18, this assembly is rotated so that the mixture contained in the mixing vessel 1 is in contact with the mixing tools disposed in the mixing head 18. This is necessary to perform the mixing operation. Attachment of the liner 11 by clamping its discharge duct extension 14 in the discharge duct 8 of the mixing vessel 1 ensures that the section of the inner liner 1 which is then on the top for the mixing operation does not drop down. Because it is designed as a film, the inner liner 11 does not have sufficient dimensional stability in this respect.

Prior to initiating the mixing operation, a certain amount of positive pressure is built up in the mixing chamber formed by cavity 3 of the mixing vessel 1 and the interior of the mixing head 18. This ensures that the inner liner 11 also remains in its position of abutting against the inner wall of the mixing vessel 1 during the mixing process and does not impede the mixing operation.

The invention was described in greater detail above with reference to the Figures, using a specific embodiment. Without departing from the scope of the current claims, further refinements will become apparent to a person skilled in the art, to be able to implement the invention.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure.

In general the terms and phrases used herein have their art-recognized meaning, which can be found by reference to standard texts, journal references and contexts known to those skilled in the art. The above definitions are provided to clarify their specific use in the context of the invention.

LIST OF REFERENCE SYMBOLS

1 Mixing vessel
2 Cart
3 Cavity
4 Feed opening
5 Mixing vessel flange

6 Section
7 Section
8 Discharge duct
9 Swivel axis
10 Handle
11 Inner liner
12 Section
13 Section
14 Discharge duct extension
15 Axle recess
16: 16.1 Clamping extension
17 Supported flange joint
18 Mixing head
19 Industrial blender
20 Electric motor
21 Flange
22 Clamping mechanism
23 Discharge flap valve

We claim:

1. A mixing vessel with an inner liner, the mixing vessel having a feed opening on an upper side of the mixing vessel with a first flange that projects radially outward from the feed opening and a discharge duct on a lower side of the mixing vessel having a discharge flap valve that can be adjusted between an open position and a closed position, the mixing vessel configured to be connected onto a mixing head of an industrial blender, said mixing head supports one or multiple mixing tool(s), for a process of blending bulk material introduced into the mixing vessel, the inner liner comprising:

a body having an upper side with a second flange that projects radially outward, the second flange bears against the first flange of the mixing vessel;

the body having a bottom side comprising a discharge duct extension which projects into the discharge duct of the mixing vessel to at least the discharge flap valve when in the closed position;

the discharge duct extension having clamping extensions and diametrically opposed axle recesses that allow the clamping extensions to extend across the discharge flap valve of the mixing vessel in the closed position;

wherein the peripheral outside of the discharge flap valve in the closed position acts against the inside wall of each of the clamping extensions so that the clamping extensions are clamped between the discharge flap valve and the inside wall of the discharge duct.

2. The mixing vessel with the inner liner according to claim 1, wherein the inner liner is made of a synthetic material that is inert with reference to the bulk material.

3. The mixing vessel with the inner liner according to claim 2, wherein the inner liner is made of a polyethylene material.

4. The mixing vessel with the inner liner according to claim 2, wherein the inner liner is formed as multiple individual sections that are welded together.

5. The mixing vessel with the inner liner according to claim 3, wherein the polyethylene material is LDPE (Low Density Polyethylene).

6. The mixing vessel with the inner liner according to claim 1, wherein the inner liner has a wall thickness between approximately 0.5 to 1.5 mm.

* * * * *